US009728842B2

(12) United States Patent
Chang et al.

(10) Patent No.: US 9,728,842 B2
(45) Date of Patent: Aug. 8, 2017

(54) ANTENNA STRUCTURE AND WIRELESS COMMUNICATION DEVICE USING THE ANTENNA STRUCTURE

(71) Applicant: Chiun Mai Communication Systems, Inc., New Taipei (TW)

(72) Inventors: Tze-Hsuan Chang, New Taipei (TW); Cho-Kang Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 235 days.

(21) Appl. No.: 14/554,818

(22) Filed: Nov. 26, 2014

(65) Prior Publication Data

US 2015/0171507 A1 Jun. 18, 2015

(30) Foreign Application Priority Data

Dec. 18, 2013 (CN) ..... 2013 1 0696297

(51) Int. Cl.

| | |
|---|---|
| ***H01Q 1/24*** | (2006.01) |
| ***H01Q 7/00*** | (2006.01) |
| *H01Q 1/38* | (2006.01) |

(52) U.S. Cl.
CPC ..... *H01Q 1/243* (2013.01); *H01Q 7/00* (2013.01); *H01Q 1/38* (2013.01)

(58) Field of Classification Search
CPC ..... H01Q 1/243; H01Q 1/38; H01Q 7/00
USPC ..... 343/702, 741
See application file for complete search history.

(56) References Cited

U.S. PATENT DOCUMENTS 7,768,466 B2 * 8/2010 Chi ..... H01Q 7/00 343/700 MS

* cited by examiner

*Primary Examiner* — Huedung Mancuso
(74) *Attorney, Agent, or Firm* — Steven Reiss

(57) ABSTRACT

An antenna structure includes an antenna holder, a feed portion, a grounding portion, and a radiating body. The antenna holder includes a plurality of surfaces. The feed portion and the ground portion are both positioned on one surface of the antenna holder. The radiating body is positioned on at least one surface of the antenna holder. The feed portion is electronically connected to a first end of the radiating body. The ground portion is electronically connected to a second end of the radiating body so as to form a loop antenna.

13 Claims, 2 Drawing Sheets

ANTENNA STRUCTURE AND WIRELESS COMMUNICATION DEVICE USING THE ANTENNA STRUCTURE

FIELD

The subject matter herein generally relates to an antenna structure and a wireless communication device using the antenna structure.

BACKGROUND

Antennas are important elements of wireless communication devices, such as mobile phones or personal digital assistants. Many wireless communication devices further employ metal housings for improving heat dissipation or other purposes.

BRIEF DESCRIPTION OF THE DRAWINGS

Implementations of the present technology will now be described, by way of example only, with reference to the attached figures.

DETAILED DESCRIPTION

Figure 1:
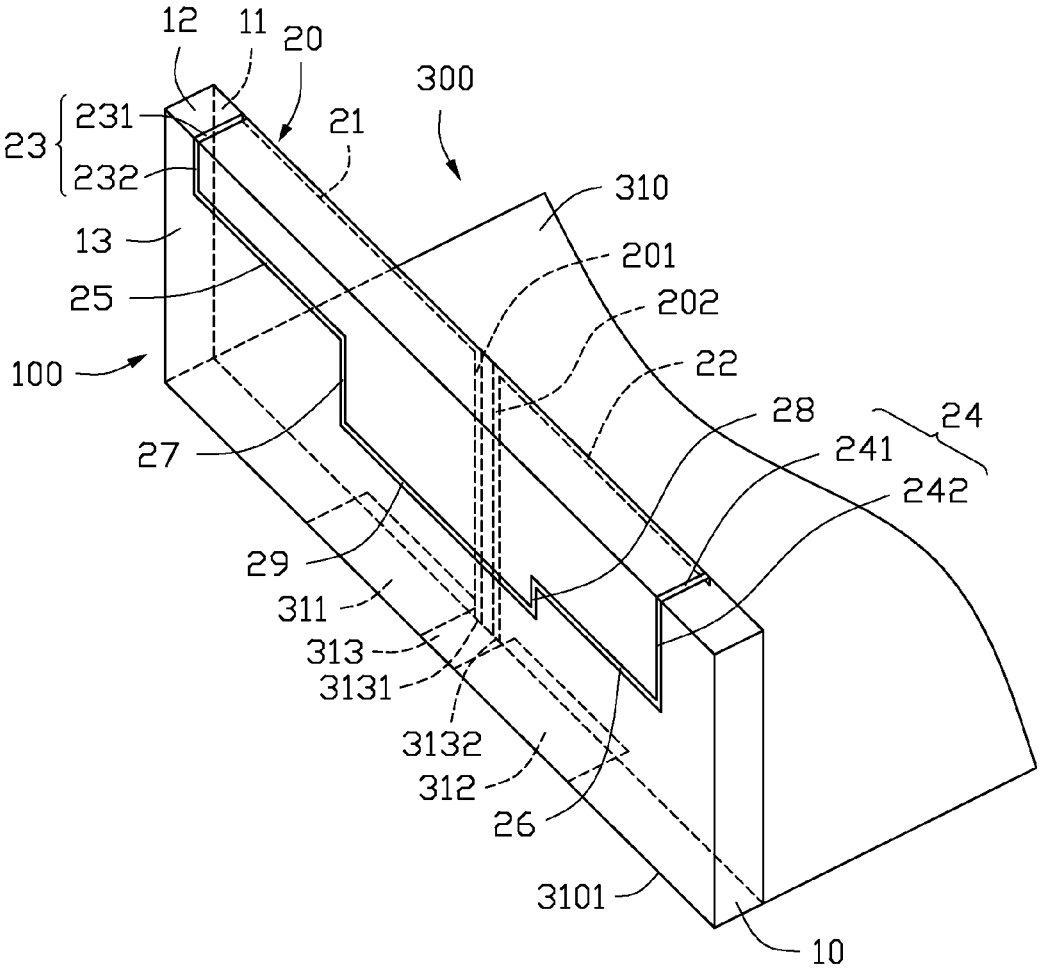
FIG. 1 is an isometric view of an embodiment of a wireless communication device employing an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates an embodiment of a wireless communication device 300. The wireless communication device 300 may be a mobile phone or a personal digital assistant, for example. The wireless communication device 300 includes a ground plane 310 and an antenna structure 100 mounted on the ground plane 310.

In this embodiment, the ground plane 310 is formed by a metal housing of the wireless communication device 300 and is configured to provide a ground for the antenna structure 100. The ground plane 310 includes an edge 3101. The ground plane 310 has a first keep-out-zone 311 and a second keep-out-zone 312. The purposes of the first keep-out-zone 311 and the second keep-out-zone 312 are to not permit other electronic elements (such as a camera, a vibrator, a speaker, etc.) from being placed in a predetermined area where it may interfere with the antenna structure 100. In this embodiment, the first keep-out-zone 311 and the second keep-out-zone 312 are both adjacent to the edge 3101 and are spaced from each other. Then, a metal area 313 is formed between the first keep-out-zone 311 and the second keep-out-zone 312. A signal feed terminal 3131 and a signal grounding terminal 3132 are positioned at the metal area 313.

The antenna structure 100 includes an antenna holder 10, a feed portion 201, a grounding portion 202, and a radiating body 20. In this embodiment, the antenna holder 10 can be made of a dielectric material, such as an epoxy resin glass fiber, and is perpendicularly positioned on one end of the grounding plane 310. In this embodiment, the radiating body 20, the feed portion 201, and the grounding portion 202 are all positioned on surfaces of the antenna holder 10. The radiating body 20 has a first end electronically connected to the feed portion 201 and a second end electronically connected to the grounding portion 202. That is, the feed portion 201, the radiating body 20, and the grounding portion 202 are connected in that order to cooperatively form a loop antenna.

In this embodiment, the antenna holder 10 is substantially rectangular and includes a first surface 11, a second surface 12, and a third surface 13. The first surface 11 is spaced from and parallel to the third surface 13. The second surface 12 is perpendicularly connected to the first surface 11 and the third surface 13. In this embodiment, the second surface 12 is spaced from and parallel to the ground plane 310. The third surface 13 is positioned on and collinear with the edge 3101. A width of the antenna holder 10 is about 0.7 millimeters (mm).

The feed portion 201 and the grounding portion 202 are both positioned on the first surface 11 of the antenna holder 10. The feed portion 201 is perpendicularly connected to the signal feed terminal 3131 so as to provide current to the antenna structure 100 and extends towards the second surface 12. In this embodiment, the feed portion 201 is substantially a strip and a distal end of the feed portion 201 is collinear with the second surface 12. The grounding portion 202 is spaced from and parallel to the feed portion 201. The grounding portion 202 is perpendicularly connected to the grounding terminal 3132 so as to ground the antenna structure 100 and extends towards the second surface 12. In this embodiment, the grounding portion 202 is substantially a strip and a distal end of the grounding portion 202 is collinear with the second surface 12.

The radiating body 20 includes a first radiating portion 21, a second radiating portion 22, a third radiating portion 23, a fourth radiating portion 24, a fifth radiating portion 25, a sixth radiating portion 26, a seventh radiating portion 27, an eighth radiating portion 28, and a ninth radiating portion 29. The first radiating portion 21 and the second radiating portion 22 are both positioned on the first surface 11. The first radiating portion 21 is substantially a strip. The first radiating portion 21 is perpendicularly connected to an end of the feed portion 201 away from the signal feed terminal 3131 and extends away from the ground portion 202. The second radiating portion 22 is substantially a strip. The second radiating portion 22 is perpendicularly connected to an end of the ground portion 202 away from the grounding terminal 3132 and extends away from the feed portion 201. That is, the first radiating portion 21 and the second radiating portion 22 oppositely extend from each other.

The third radiating portion 23 includes a first radiating section 231 and a second radiating section 232. The first radiating section 231 is positioned on the second surface 12. In this embodiment, the first radiating section 231 is substantially a strip and is perpendicularly connected to an end of the first radiating portion 21 away from the feed portion 201. The second radiating section 232 is positioned on the third surface 13. In this embodiment, the second radiating section 232 is substantially a strip and is perpendicularly connected to an end of the first radiating section 231 away from the first radiating portion 21.

The fourth radiating portion 24 includes a first connecting section 241 and a second connecting section 242. The first connecting section 241 is positioned on the second surface 12. In this embodiment, the first connecting section 241 is substantially a strip and is perpendicularly connected to an end of the second radiating portion 22 away from the grounding portion 202. The second connecting section 242 is positioned on the third surface 13. In this embodiment, the second connecting section 242 is substantially a strip and is perpendicularly connected to an end of the first connecting section 241 away from the second radiating portion 22. The first connecting section 241 is spaced from and parallel to the first radiating section 231. The second connecting section 242 is spaced from and parallel to the second radiating section 232.

The fifth radiating portion 25, the sixth radiating portion 26, the seventh radiating portion 27, the eighth radiating portion 28, and the ninth radiating portion 29 are all positioned on the third surface 13. The fifth radiating portion 25 is substantially a strip. The fifth radiating portion 25 is perpendicularly connected to an end of the second radiating section 232 away from the first radiating section 231 and extends towards the second connecting section 242. The sixth radiating portion 26 is substantially a strip. The sixth radiating portion 26 is perpendicularly connected to an end of the second connecting section 242 away from the first connecting section 241 and extends towards the second radiating section 232. In this embodiment, the fifth radiating portion 25 is spaced from and parallel to the sixth radiating portion 26.

The seventh radiating portion 27 is substantially a strip. The seventh radiating portion 27 is perpendicularly connected to an end of the fifth radiating portion 25 away from the second radiating section 232 and extends towards the first keep-out-zone 311. The eighth radiating portion 28 is substantially a strip. The eighth radiating portion 28 is perpendicularly connected to an end of the sixth radiating portion 26 away from the second connecting section 242 and extends towards the second keep-out-zone 312. In this embodiment, the seventh radiating portion 27 is spaced from and parallel to the eighth radiating portion 28. A length of the seventh radiating portion 27 is greater than that of the eighth radiating portion 28.

The ninth radiating portion 29 is substantially a strip and has a first end perpendicularly connected to an end of the seventh radiating portion 27 away from the fifth radiating portion 25 and a second end perpendicularly connected to an end of the eighth radiating portion 28 away from the sixth radiating portion 26. In this embodiment, the ninth radiating portion 29 is parallel to the fifth radiating portion 25 and the sixth radiating portion 26.

Figure 2:
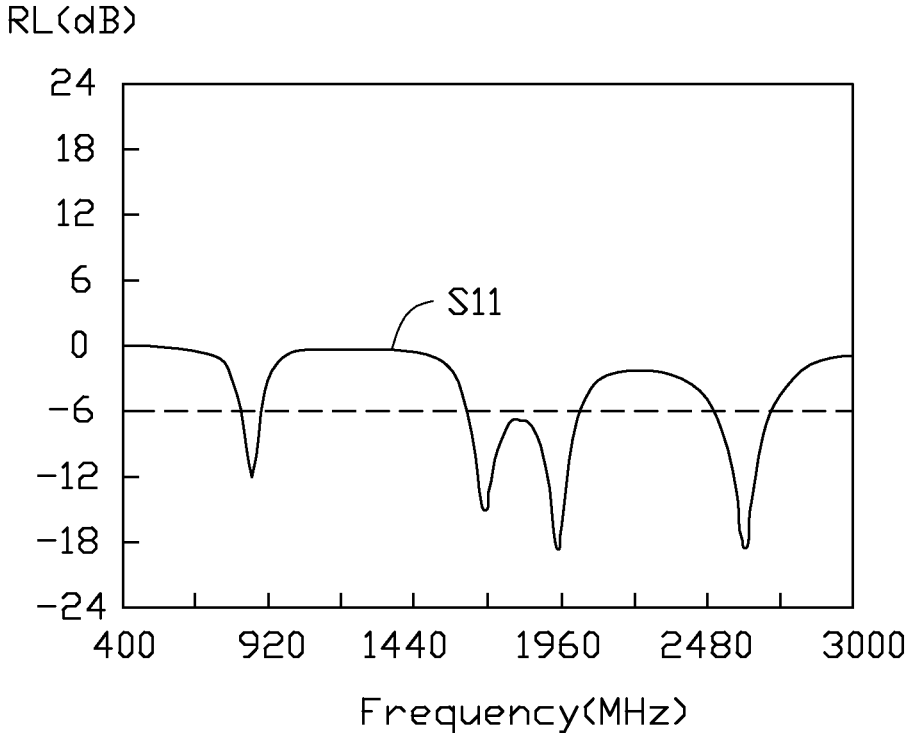
FIG. 2 is a return loss (RL) graph of the antenna structure of the wireless communication device of FIG. 1.

FIG. 2 illustrates a return loss (RL) graph of the antenna structure 100. Evidentially, when the RL of the antenna structure 100 is less than −6 dB, the antenna structure 100 has a good performance at frequency bands of about 824-894 MHz, 1710-1990 MHz, and 2500-2690 MHz, and satisfies radiation requirements.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

an antenna holder comprising a first surface, a second surface, and a third surface, the first surface spaced from and parallel to the third surface, the second surface perpendicularly connected to the first surface and the third surface;

a feed portion positioned on the first surface;

a ground portion positioned on the first surface; and a radiating body comprising a first radiating portion, a second radiating portion, a third radiating portion, and a fourth radiating portion;

wherein the feed portion is electronically connected to a first end of the radiating body, and the ground portion is electronically connected to a second end of the radiating body so as to form a loop antenna;

wherein the first radiating portion is positioned on the first surface and is perpendicularly connected to the feed portion, the second radiating portion is positioned on the first surface and is perpendicularly connected to the ground portion; the third radiating portion comprises a first radiating section and a second radiating section connected in that order, the fourth radiating portion comprises a first connecting section and a second connecting section connected in that order, the first radiating section and the first connecting section are positioned on the second surface, and the second radiating section and the second connecting section are positioned on the third surface.

2. The antenna structure of claim 1, wherein the first radiating section is perpendicularly connected to the first radiating portion and the first connecting section is perpendicularly connected to the second radiating portion.

3. The antenna structure of claim 1, wherein the radiating body further comprises a fifth radiating portion and a sixth radiating portion, the fifth radiating portion and the sixth radiating portion are both positioned on the third surface, the fifth radiating portion is perpendicularly connected to the second radiating section and the sixth radiating portion is perpendicularly connected to the second connecting section.

4. The antenna structure of claim 3, wherein the radiating body further comprises a seventh radiating portion, an eighth radiating portion, and a ninth radiating portion, the seventh radiating portion, the eighth radiating portion, and the ninth radiating portion are all positioned on the third surface, the seventh radiating portion is perpendicularly connected to the fifth radiating portion, the eighth radiating portion is perpendicularly connected to the sixth radiating portion, and the ninth radiating portion is perpendicularly connected between the seventh radiating portion and the eighth radiating portion.

5. The antenna structure of claim 1, wherein a width of the antenna holder is about 0.7 mm.

6. A wireless communication device comprising:

a ground plane; and an antenna structure positioned on the ground plane, the antenna structure comprising:

an antenna holder comprising a first surface, a second surface, and a third surface, the first surface spaced from and parallel to the third surface, the second surface perpendicularly connected to the first surface and the third surface;

a feed portion positioned on the first surface;

a ground portion positioned on the first surface; and a radiating body comprising a first radiating portion, a second radiating portion, a third radiating portion, and a fourth radiating portion;

wherein the feed portion is electronically connected to a first end of the radiating body, and the ground portion is electronically connected to a second end of the radiating body so as to form a loop antenna;

wherein the first radiating portion is positioned on the first surface and is perpendicularly connected to the feed portion, the second radiating portion is positioned on the first surface and is perpendicularly connected to the ground portion; the third radiating portion comprises a first radiating section and a second radiating section connected in that order, the fourth radiating portion comprises a first connecting section and a second connecting section connected in that order, the first radiating section and the first connecting section are positioned on the second surface, and the second radiating section and the second connecting section are positioned on the third surface.

7. The wireless communication device of claim 6, wherein the ground plane comprises a first keep-out-zone and a second keep-out-zone, the first keep-out-zone and the second keep-out-zone are both adjacent to an edge of the ground plane and are configured to not permit other electronic elements from being placed in a predetermined area where it may interfere with the antenna structure, the antenna holder is perpendicularly positioned above the first keep-out-zone and the second keep-out-zone.

8. The wireless communication device of claim 7, wherein the first keep-out-zone and the second keep-out-zone are spaced from each other by a metal area.

9. The wireless communication device of claim 8, wherein a signal feed terminal and a grounding terminal are positioned at the metal area, the signal feed terminal is electronically connected to the feed portion and the grounding terminal is electronically connected to the ground portion.

10. The wireless communication device of claim 6, wherein the first radiating section is perpendicularly connected to the first radiating portion and the first connecting section is perpendicularly connected to the second radiating portion.

11. The wireless communication device of claim 6, wherein the radiating body further comprises a fifth radiating portion and a sixth radiating portion, the fifth radiating portion and the sixth radiating portion are both positioned on the third surface, the fifth radiating portion is perpendicularly connected to the second radiating section and the sixth radiating portion is perpendicularly connected to the second connecting section.

12. The wireless communication device of claim 11, wherein the radiating body further comprises a seventh radiating portion, an eighth radiating portion, and a ninth radiating portion, the seventh radiating portion, the eighth radiating portion, and the ninth radiating portion are all positioned on the third surface, the seventh radiating portion is perpendicularly connected to the fifth radiating portion, the eighth radiating portion is perpendicularly connected to the sixth radiating portion, and the ninth radiating portion is perpendicularly connected between the seventh radiating portion and the eighth radiating portion.

13. The wireless communication device of claim 6, wherein a width of the antenna holder is about 0.7 mm.

* * * * *